United States Patent [19]

Weiss

[11] 4,216,778

[45] Aug. 12, 1980

[54] ORTHOPEDIC APPLIANCE

[76] Inventor: Dennis H. Weiss, 118 E. North St., Wooster, Ohio 44691

[21] Appl. No.: 888,936

[22] Filed: Mar. 22, 1978

[51] Int. Cl.[2] ..... A61F 5/14

[52] U.S. Cl. ..... 128/581

[58] Field of Search ..... 128/586, 595, 581, 594, 128/596; 36/43, 44

[56] References Cited

U.S. PATENT DOCUMENTS

| | | | |
|---|---|---|---|
| 2,401,514 | 6/1946 | Scholl | 128/595 |
| 3,903,621 | 9/1975 | Dubner | 128/595 X |

*Primary Examiner*—John D. Yasko

*Attorney, Agent, or Firm*—Thomas E. Beall, Jr.

[57] ABSTRACT

Support for the bottom surface of a foot so as to maintain it in a normal, weight bearing posture is obtained by a rigid plate that extends under the area of the foot, except for the area under the toes and inner arch. The plate is of generally uniform thickness with tapered toe and heel portions. The rigid plate is obtained by molding an impression of the foot while the foot is held at right angles to the leg and in a semi-loaded or semi-pronated position.

9 Claims, 9 Drawing Figures

ORTHOPEDIC APPLIANCE

BACKGROUND OF THE INVENTION

It has generally been thought in the past that it was important to support the arch of a foot, and various arch supports are well known, for example as shown in British patent 583,683. However, arch supports do not correct many problems relating to abnormal feet.

In association with an arch support or a resilient sole of a shoe, it is known to mold such resilient sole from the shape of a particular persons foot, for their use, as shown in the U.S. Pat. No. 3,121,431, to Rosenhaft Feb. 18, 1964. However, this does not support the critical bones to correct abnormal feet, but only makes walking with normal feet more comfortable.

As an orthopedic appliance, it is known to provide various tensioning devices for the feet, in hopes that they will change or correct abnormalities, for example as shown in German Patentschrift No. 552,028, of 1932.

SUMMARY OF THE INVENTION

It is an object of the present invention to provide an orthopedic appliance that may be used on the inside of any shoe, and which is molded to a specific shape of the users foot so as to correct many foot abnormalities. This device will cause a foot to function in a straight, normal, neutral position, or as close to normal as limitations of the shoe design and shapes will permit for people having otherwise abnormal feet.

The present invention is to be distinguished from an arch support, because it does not include any support material in the area of the foot where arch supports usually are built up. Arch supports are an obsolete method of attempting to correct foot deformities and difficulties. An arch support, rather than assisting in foot function, blocks normal foot function in that it attempts to block the normal heel eversion and pronation of a proper functioning foot. The arch support crutches the foot and ultimately results in muscle atrophy, due to the loss of normal foot function.

The orthopedic appliance in the present invention is a rigid plate member extending under the area of the bottom of the foot, except for the area under the inner arch and toes, which plate member is rigid and has the contour on its top or foot engaging surface corresponding to the contour of the bottom of the foot when the foot is in its correct position. The plate is preferably of generally uniform thickness, except for tapered front and rear portions. The appliance is obtained by supporting a foot generally at right angles to the leg and holding the foot in its semi-loaded or semi-pronated position, without loading, so that the foot is in a normal position despite the fact that the foot might otherwise assume an abnormal position if loaded. In this position, a cast is made, and then the appliance is molded from the cast.

BRIEF DESCRIPTION OF THE DRAWINGS

Further objects, features and advantages of the present invention will become more clear from the following detailed description of a preferred embodiment, as shown in the accompanying drawing, wherein.

DETAILED DESCRIPTION

Figure 2:
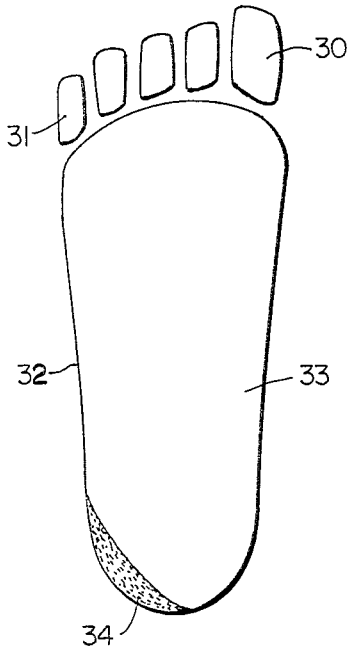
FIGS. 2, 3, 4, 5, 6, and 7 illustrate schematically the bottom of a foot in the manner in which weight shifts during walking.
Figure 3:
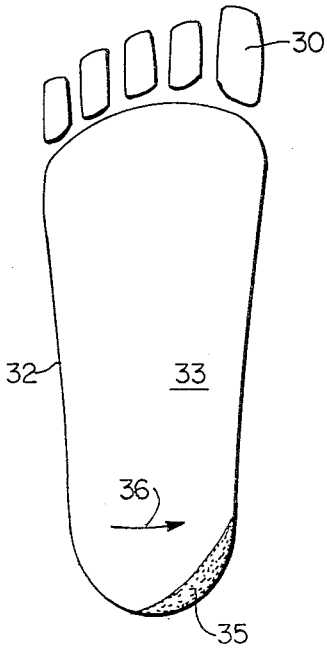
Figure 4:
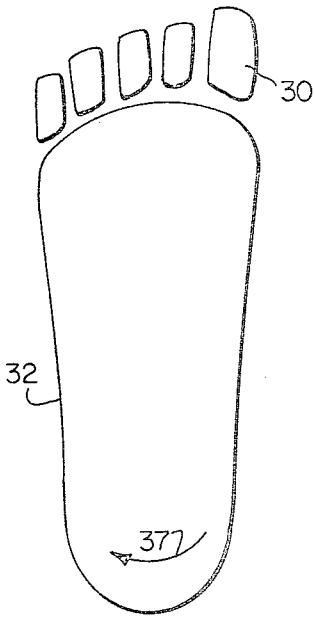
Figure 5:
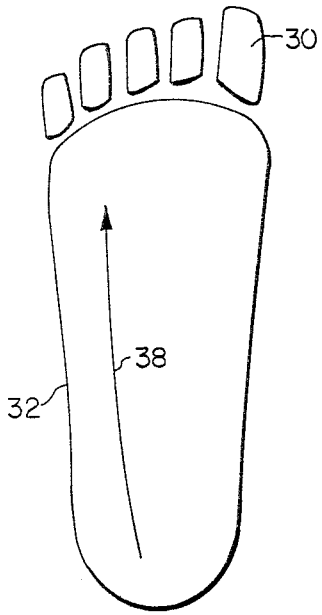
Figure 6:
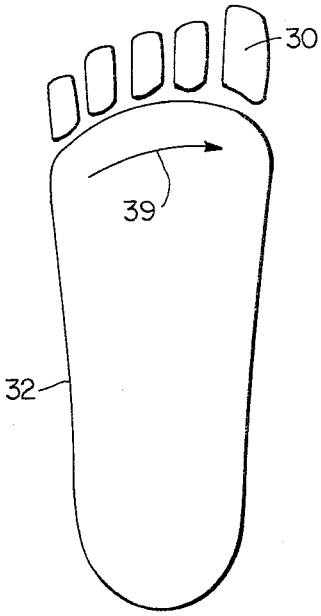
Figure 7:
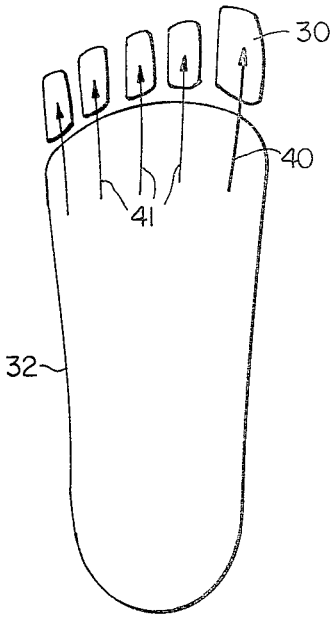

As background of the present invention, general foot function will be discussed. From a biomechanical standpoint, the foot functions as follows during walking, for example as will be illustrated in FIGS. 2–7 with respect to the bottom of a right foot having a big toe 30, little toe 31, arch area 33, and outside portion 32, for purposes of orientation. As shown in FIG. 2, the normal weight distribution starts on the lateral side of the heel at 34 in FIG. 2; the heel rolls medially as shown at 36, to shift the predominate weight distribution to the area 35 as shown in FIG. 3; then the heel rolls back laterally as shown at 37 in FIG. 4; the weight then moves forward along the lateral weight bearing surface of the bottom of the foot forward to the fifth metatarsal head, as shown along line 38 in FIG. 5; then the weight shifts along line 39 of FIG. 6 across the metatarsal bones to the first metatarsal bone; at this time, the weight then moves forward along line 40 through the first or big toe, with the remaining toes aiding in the lift off with a small amount of weight shifting along lines 41, as shown in FIG. 7. Nowhere in the foot function as described above do the bones of the so-called inner longitudinal arch come into function in the normal movements of the foot.

In abnormal feet, there is an excessive amount of pronation in flacid-type feet, there is supination in rigid type feet, and there are variations of abnormal foot structures including variations in bone patterns, length patterns, variations in muscle tone, and ligamental tones.

The appliance of the present invention is developed as follows. A negative plaster impression is made of the patient's foot, while the foot is held at right angles to the leg and with the foot held in a semi-loaded or semi-pronated position, which is similar to a normal weight bearing posture. Even an abnormal foot, when held in such a position, will assume a normal weight bearing posture. If a negative plaster were to be obtained from an abnormal foot in its load-bearing position, such a negative plaster impression would be entirely different from that obtained according to the present invention, and any appliance made from such a weight bearing negative plaster impression would only hold the foot in its abnormal position and provide no corrective action, and further be totally contrary to the present invention. Proceeding with the present invention, from the above-mentioned negative is poured a positive mold, on which the orthopedic appliance of the present invention is fabricated. That is, first a negative impression is made, then a positive mold is obtained, and thereafter the appliance of the present invention is formed on the surface of the positive mold that duplicates the patient's foot in its semi-loaded or semi-pronated position.

As a specific example, the material used to form the present appliance on the positive mold is a clear thermoplastic, that is synthetic thermal setting resin, made in Western Germany under the trademark ROHADUR PLASTIC. This material maintains its integrity until heated to 287°, when it then softens and can be molded over the positive cast of the foot. In such molding, the area under the arch is either not molded or cut away after being molded. The resulting rigid plate appliance has a shape that follows the pattern of the load bearing and weight distribution explained in the previous paragraphs for a normal foot, even though made from a foot that would be classified as abnormal.

By putting the patient's foot in a straight position during the making of the negative mold, regardless of whether it turns in, whether it pigeon toes, whether it duck walks, whether it turns out, whether it is flat footed or whether it is a pes cavus foot, the appliance of the present invention will force the foot to walk straighter and function better by holding it in what would be for that foot a normal weight bearing posture.

The appliance of the present invention can be worn inside almost any type of shoe, except shoes without a heel counter. The appliance works equally well for men, women, children and elderly patients.

The specific material, mentioned above, is a relatively thin material and the thickness is determined by the weight of the individual for optimum results, that is it is desirable to have the applicance as thin as possible to reduce weight and bulk, while at the same time having it thick enough for that particular persons weight so that the appliance will effectively be rigid when used by that person. Therefore, the appliance may be made thinner for a person of less weight. Generally, the appliance will be 2.5 to 3 mm. in thickness for the particular material mentioned above, although a thinner appliance may be constructed of a stronger material and a thicker appliance would be required if the material was weaker than that specifically mentioned above.

Figure 1:
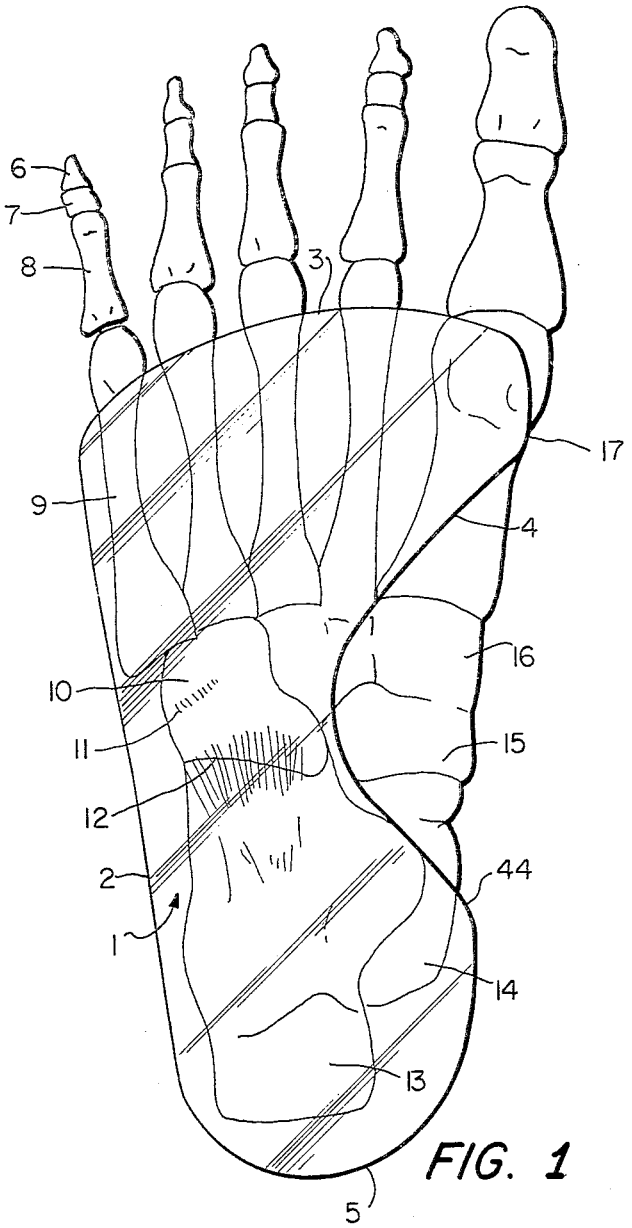
FIG. 1 is a bottom view of an appliance constructed according to the present invention and engaging a human foot, which foot is only illustrated with respect to its bones.

In FIG. 1, there is shown the bone pattern of a foot, with the supporting buttress of the foot being along the lateral aspect. The cuboid bone 10, with the peroneal grove 11 is the key to this buttress. The appliance in the present invention maintains this cuboid bone in its normal position preventing it from lowering when the foot is weight bearing. There is a slight arch (not to be confused with the inner portion of the foot commonly referred to as the arch) along this lateral aspect and beneath the cuboid bone 10; the appliance in the present invention maintains this position.

The appliance 1 of the present invention is shown with a lateral outside edge 2, a forward edge 3, an inner curved edge 4, and a rear or heel edge 5. As shown, the appliance of the invention does not cover any portion of the toe bones 6, 7 and 8, so that the appliance of the present invention does not interfere with the normal pushing off of the foot as shown in FIG. 7. The appliance is placed under what is commonly called the ball of the foot, so as to cover at least a major portion of the second through fifth metatarsal bones 9, and preferably a portion of the first metatarsal bone, with the covering of a major portion of the forward one-half of the first metatarsal bone being preferred. The appliance preferably covers the entire area of the cuboid bone 10. Preferably, the appliance ends just behind the metatarsal-phalangeal articulations so as not to interfere with the normal functioning of the articulations but to aid in the even distribution of weight across these bones.

There is no real arch across the heads of the metatarsal bones, they are all weight bearing as is easily discernible in any evaluation of the shapes of the bones. The metatarsal bones have thin shafts, transmitting weight from the tarsal bones forward to the heads of the bones, which are thick, weight bearing structured bones. The first metatarsal bone is normally twice the thickness of the lesser four metatarsal bones as it carries twice the weight of the other metatarsal bones. FIG. 1 depicts the appliance covering the heel 13; the cuboid 10, the styloid process at the base of the fifth metatarsal and forward to just behind the metatarsal head; across the metatarsal parabola, back on the medial side to near the base of the metatarsal shaft, laterally to the medial side of the cuboid, from where it curves medially back under the heel bone. It can be seen that the bones of the inner arch have no contact with the appliance and therefore there is no arch support. There is no arch support, because an arch support, regardless of the type, crutches the foot, blocks the normal pronatory movement of the foot in the stance phase of gate. The appliance of the present invention permits the normal movement, but limits abnormal movement by maintaining weight distribution from the heel through the lateral side of the foot through the cuboid bone, the lateral metatarsal shafts and across the metatarsals to the first toe. The arch is not a weight bearing area in a normal foot and is not a weight bearing area with the appliance of the present invention. The appliance keeps the pressure off of the bones of the inner arch—the navicular and the first and second cuneiform bones. It holds the lateral side of the foot, the weight bearing area of the foot, in its normal position when properly made.

Figure 8:
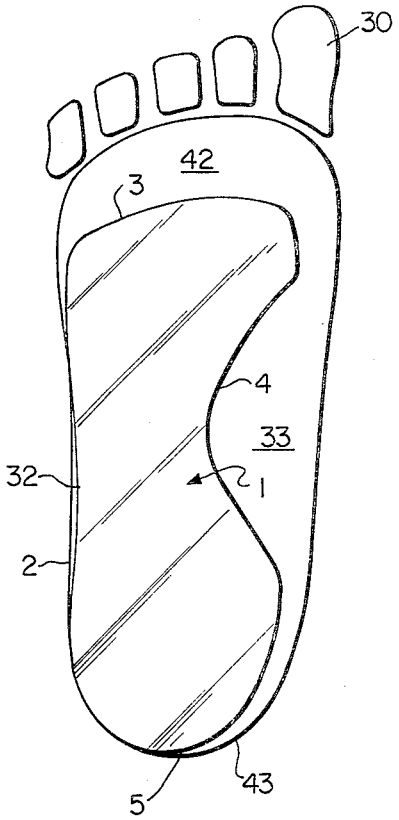
FIG. 8 illustrates schematically the outline of a human foot, with the orthopedic appliance according to the present invention placed on the bottom of the foot.

In FIG. 8, the proportioning and placement of the appliance is illustrated with respect to the bottom of a foot having a heel 43, lateral side 32, inner arch area 33, ball 42, and first or big toe 30.

Figure 9:
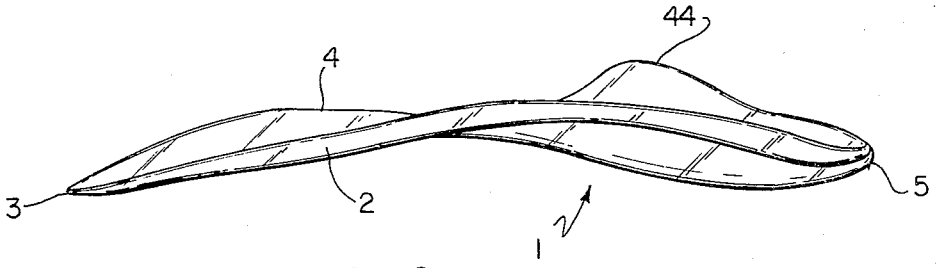
FIG. 9 is a side view of the orthopedic appliance according to the present invention.

As shown in FIG. 9, the appliance has a compound curve, and for this particular appliance molded to the shape of a specific individual, it is seen that the arch on the lateral side of the foot (not to be confused with the inner arch or commonly called arch), is quite high under the cuboid bone. Thus, the appliance in the present invention, among other things, supports the lateral arch under the cuboid bone, and does not provide any arch support on the medial side of the foot. The appliance thereby controls under the cuboid bone and lateral side of the foot in a correct straight posture.

An abnormal posture of the foot in its load bearing position (that is without the appliance in the present invention) will have many abnormal effects throughout the whole leg, knee, back, etc. When the foot of a person having such problems is held at right angles to the leg and aligned so that the heel and foot are lined up properly, and without any weight bearing, such foot will be in a normal posture for that person. It is in this position that the molds are made, so that the appliance will hold the foot in this position even when the foot later becomes weight bearing with the appliance engaging the bottom of the foot. Thereby, numerous abnormalities resulting in an otherwise abnormal foot can be corrected. With the specific shape of the appliance in relationship to the foot, the appliance can even be used in running shoes, and in actual practice a man of medical training who for many years had been running one or two miles with foot problems was able to run regularly five miles without such foot problems when fitted with an appliance constructed according to the present invention. With further reference to FIG. 1, it is seen that the bones 15, 16 within the arch area of the foot are not directly supported or engaged by the appliance. The appliance has on the inner side, preferably, an upwardly extending portion 44 to assist in the positioning of the heel. Therefore, it is seen that throughout all of the movements depicted in FIGS. 2 through 7, the bones are maintained in their proper orientation by being rigidly interconnected with the appliance.

While a preferred embodiment of the present invention has been specifically described, for the advantages of the details and for purposes of illustrations, further embodiments, variations and modifications are contemplated, all within the spirit and scope of the following claims.

I claim:

1. An orthopedic appliance to support a foot in a normal weight bearing posture, comprising:

a rigid plate having an upper foot engaging surface adapted to conform to the normal weight bearing posture of the wearer's foot, and having an outside lateral edge adapted to generally extend outside of the cuboid and heel bones, a rear edge adapted to extend outside of the heel bone area, a forward edge adapted to extend beneath the forward portion of the metatarsal bones, and an inner periphery being concave toward the lateral outside edge so as to be adapted to extend adjacent the inside portion of the heel bone without being adapted to extend supportingly beneath the medial arch.

2. The appliance of claim 1, wherein said plate is tapered outwardly across its forward edge, rounded at its rearward edge, and generally of uniform thickness throughout the remainder of its extent.

3. The appliance of claim 2, wherein said plate is constructed entirely of a thermo setting synthetic resin.

4. The appliance of claim 3, where the entire outer peripheral edge of the appliance is defined by said lateral outside edge, forward edge, inner periphery, and rearward edge.

5. The appliance of claim 1, wherein said plate is constructed entirely of a thermo setting synthetic resin.

6. The appliance of claim 1, where the entire outer peripheral edge of the appliance is defined by said lateral outside edge, forward edge, inner periphery, and rearward edge.

7. A method of constructing an orthopedic appliance to be worn in contact with the bottom of the foot to maintain the foot in a correct or normal weight bearing posture, comprising:

supporting the foot at generally right angles to the leg in a predominantly non-weight bearing posture with the heel and toes properly aligned in what would be a correct weight bearing posture for the foot; constructing a mold of the bottom of the foot when held in the position of the preceding step at least in the areas of the metatarsal bones, cuboid bone, and heel bone;

employing said mold constructed according to the preceding step to mold a rigid appliance having a support surface conforming to the mold surface so as to conform to the foot within the area of the metatarsal bones, cuboid bone, and heel bone, without a support surface in conformity with what would be the medial arch area of the foot, so that said appliance has an outer periphery of its foot support surface defined by an outside lateral edge generally extending outside of the cuboid and heel bones, a rear edge extending outside of the heel bone area, a forward edge extending beneath the forward portion of the metatarsal bones, and an inner concave edge extending toward the lateral edge and adjacent the inside portion of heel bone without extending beneath the medial arch.

8. The method of claim 7, wherein said step of molding includes heating a thermosetting synthetic resin and applying it to a mold of the foot so as to conform to the mold.

9. The method according to claims 7 or 8, including tapering the forward most edge of the appliance and the rearward most edge of the appliance.

* * * * *